United States Patent [19]

Goodwin

[11] 4,125,283

[45] Nov. 14, 1978

[54] COLLATOR UNLOADER

[75] Inventor: E. L. Goodwin, Arlington Heights, Ill.

[73] Assignee: Addressograph Multigraph Corporation, Los Angeles, Calif.

[21] Appl. No.: 811,790

[22] Filed: Jun. 30, 1977

[51] Int. Cl.[2] ..... B65G 7/12

[52] U.S. Cl. ..... 294/87 R; 214/16.6

[58] Field of Search ..... 294/87, 87 A, 87.22, 294/87.24; 271/173; 214/16.6

[56] References Cited

U.S. PATENT DOCUMENTS 1,086,202 2/1914 Morris ..... 294/87 A 2,907,479 10/1959 Cunningham ..... 214/16.6

*Primary Examiner*—James B. Marbert

*Attorney, Agent, or Firm*—Ray S. Pyle

[57] ABSTRACT

A device for unloading a plurality of individual stacks of paper from individual compartments of a collator simultaneously. The device consists of a multiple set of grippers operated manually by a piston grip ratchet device. The grippers are registered with the stacks of the collator, the ratchet device operated to grip the several stacks, and the device with the stacks of paper gripped thereby removed to a convenient unloading station.

4 Claims, 3 Drawing Figures

COLLATOR UNLOADER

BACKGROUND OF THE INVENTION

Office copying, duplicating, and similar reproduction is carried out in a multitude of equipment configurations. However, almost universally, the reproduction process results in paper sheets which ultimately come to a pocket holding device wherein shelves are placed one above the other in order that the distribution device can project the sheets into the area between two shelves, normally referred to as a pocket or compartment.

Conventionally, the shelves are notched in order that the operator is able to grip a stack of sheets placed in a particular pocket without the need to pry under a stack.

Although there are mechanical devices to feed sheets one at a time out of collator holding bin structure, the removal of an entire stack from a pocket is generally accomplished manually.

Manual removal of stacks of sheets from pockets is a relatively slow procedure and while it is being done the collecting pockets cannot be used for a new run from the source projecting sheets into the collector pocket. Hence, if that source is a production machine, the machine is down while the previous run is being removed. Of course, a second or third collecting bin is sometimes available, but even so it is a slow labor procedure to remove the stacks from a collator collecting bin unit. For example, there may be 50 or more pockets in one unit, and unloading those pockets one at a time is labor-time consuming.

SUMMARY OF THE INVENTION

The purpose of this invention is to enable the simultaneous removal of sheet stacks from a multiple number of pockets rapidly and efficiently.

An object of the invention is to provide a gang of mechanical grippers which may be operated simultaneously to grasp a multiple number of stacks and to remove those stacks all in one motion.

IN THE DRAWING

Figure 1:
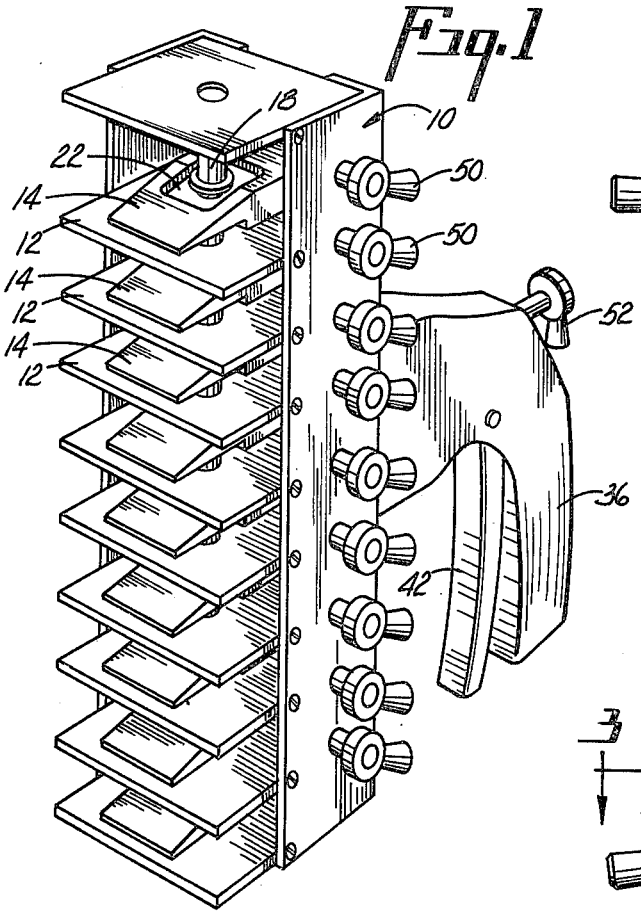
FIG. 1 is a perspective view of the unloader.
Figure 3:
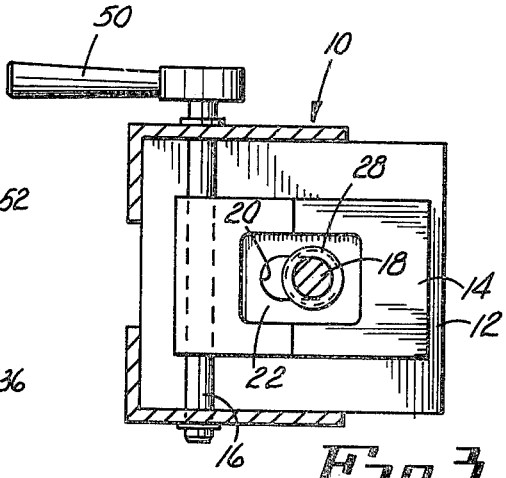
FIG. 3 is a section taken along line 3—3 of FIG. 2.

The drawings illustrate a multiple grip unloader for removing paper stacks from a multiple compartment bin unit. The ultimate destination of paper sheets placed in a collator machine is a position on a support tray in a vertical stack of trays. There are rotary collator collector, but this invention is directed to the unloading from the vertical array type of collator.

The illustrated embodiment of the invention employs an elongated frame 10 having fixed position platforms 12 secured to the side walls of the frame.

There are a plurality of movable gripper arms 14, one for each of the platforms 12. Each of the platforms and movable gripper arms constitute a pair of gripper arms, each pair having one arm secured to the frame and the other arm movable relative to the frame. These pairs of gripper arms terminate at the extremities in cooperating gripper configuration such that when closed together they will clamp upon a stack of paper sheets and hold them by frictional action and clamping force.

Each gripper arm 14 is carried by means of a pivot rod 16 which bridges between the side walls of the frame 10. The grippers are thereby shiftable between an open position spaced from its cooperating platform arm, and a position closer to the platform arm. Pivoting, although not the exclusive means of mounting the gripper arms, is believed to be the preferred means of mounting.

A rod 18 extends vertically through openings 19 in each of the platforms 12 and serves as one portion of a gang interconnecting means for driving the movable gripper arms 14 in unison.

Figure 2:
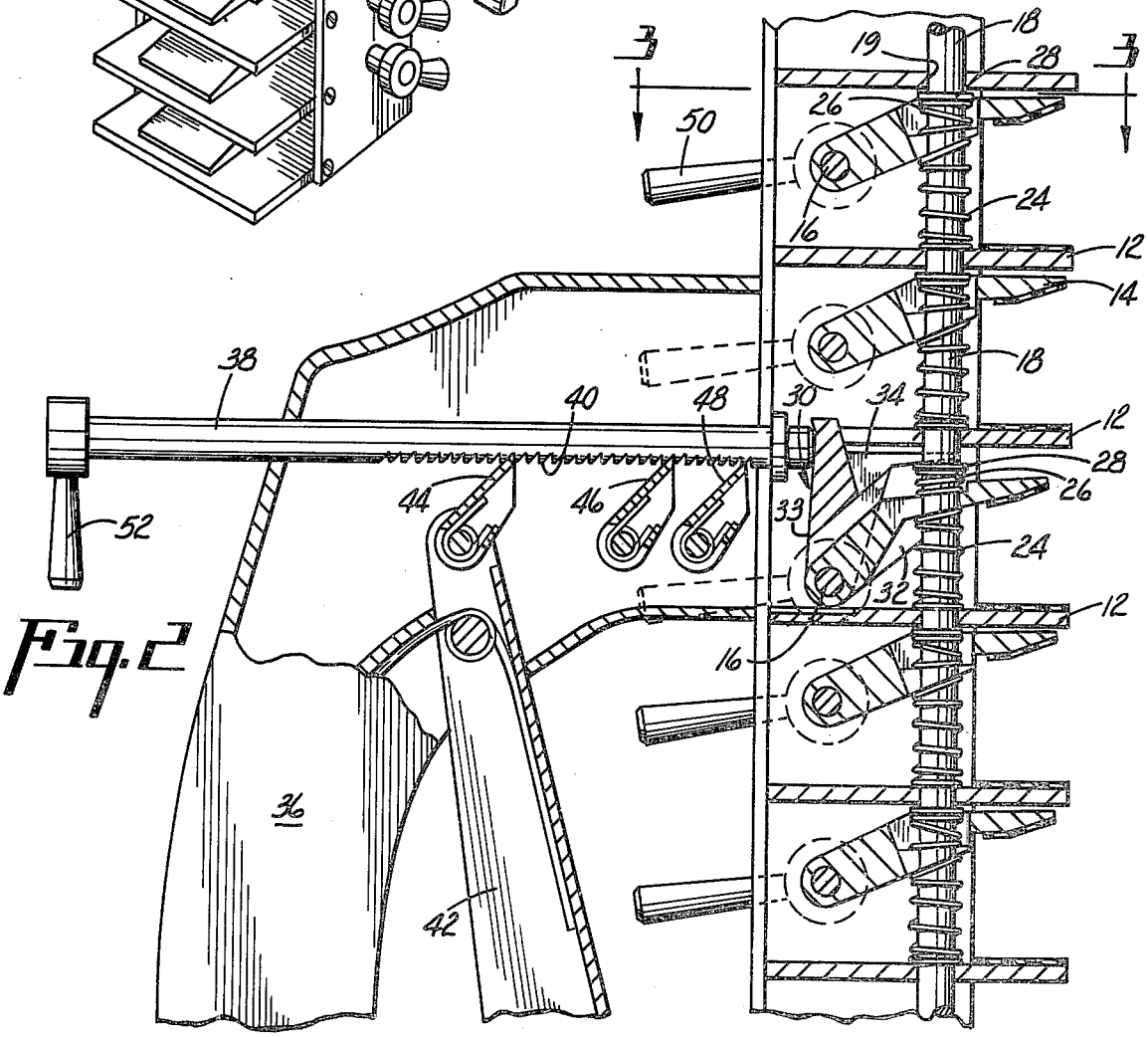
FIG. 2 is a sectional elevation through the center line of the unloader.

Each of the gripper arms 14 has an opening 20 aligned with the plurality of openings 19 and the rod 18 extends also through the plurality of openings 20. Each opening 20 is surrounded by a depression cup area 22 leaving a thinner web of material surrounding the opening 20. A spring 24 encompassing the rod 18 in a position between a fixed platform 12 and its cooperating movable gripper arm 14, impinges the web of material remaining around the opening 20 and urges the movable gripper arm to an open position as illustrated in FIG. 2. A smaller but stronger spring 26 on the opposite side of the web around the opening 20 is captured by a retainer ring 28 fixed to the rod 18.

As thus described, if the rod 18 is forced downwardly with respect to frame 10, the compression of spring 26 will overcome the resistance of spring 24 and permit the gripper arm 14 to close with respect to the platform 12, but when the force driving the rod 18 is removed, then the plurality of springs 24 will drive against the plurality of arms 14, and because there is no resistant force applied to the springs 26, the rod 18 and its plurality of arms 14 will elevate and open the gap between the arms and platform 12.

A drive lever 30 is carried on the pivot rod 16 of one of the movable gripper arms. The illustration in FIG. 2 shows the lever 30 mounted on the central pair of gripper arms. The lever consists of side walls 32, a back wall 33, and a cap 34 bridging the side walls. The effect is very much like the human hand wherein the thumb and small finger would represent pivot points, the index and third finger would represent the portions of the cap 34 and the back of the hand representing the back wall 33. The rod 18 will then occupy the position of the second finger, and if the hand is pivoted forwardly and downwardly, a drive would be experienced on the retainer ring 28 of the cooperating gripper arm.

To produce that downwardly driving force there has been provided a ratchet drive means with a pistol grip handle and finger operated lever for manual operation. The handle 36 carries a drive rod 38 which has a rack 40 on a portion of its surface. Lever handle 42 is operated by the finger to drive pawl 44 to engage with rack 40. Latch pawls 46 and 48 cooperate to provide holding action and produce a vernier scale of holding by reason of being out of synchronization as illustrated in FIG. 2. In FIG. 2 the one pawl 46 is fully engaged with the rack 40 and holds the rack against return. The pawl 48 is idle and were it not for the pawl 46, rod 38 could reverse. However, slightly more advance of rod 38 will bring pawl 48 into engagement and release the pawl 46. Two pawls are not essential, but the illustrated embodiment does provide a finer degree of clamping action with a coarse-cut rack 40.

By repeated operation of handle 42, rod 38 is advanced against the back wall 33 of the drive lever 30 causing the lever to pivot about the axis of pivot rod 16, and to force the ring 28 to compress the spring 26 and drive the movable 14 towards its platform 12. The cap 34 serves the same purpose as the holding pins of the remainder of the arms, and the pin below the washer will enable the drive lever 30 to force the rod 18 in a gang movement of all of the gripper arms.

It is sometimes desirable to release the gripping action of an individual pair of arms independently of the release of all of the gripper arms. Therefore, release handles 50 have been secured to the ends of the pivot rods 16 protruding through the side of the frame 10 and these handles may be manually driven to compress the spring 26, pivoting the particular gripper arm slightly toward the open position to thereby release the stack of paper held.

When it is desired that all of the arms be released and restored to the position shown in FIG. 2, a handle 52 is manually rotated to force the rack 40 out of engagement with the pawls 44, 46 and 48. Such disengagement allows the force of the several springs 24 to elevate rod 18 and hence reverse-rotate the lever 30 and driving of the rod 38 to the retracted position shown in FIG. 2.

What is claimed is:

1. A multiple grip unloader for removing paper stacks from a multiple compartment bin unit, comprising:

an elongated frame;

a plurality of pairs of gripper arms, each pair having one arm secured to the frame and the other arm movable relative to the frames;

said pairs each terminating at the extremities in cooperating gripper configuration;

a ratchet drive means with a pistol grip handle and finger operated lever for manual operation;

a gang interconnecting means for driving said movable arms in unison; and means for transfer of drive from said ratchet drive means to said gang interconnecting means.

2. A multiple grip unloader for removing paper stacks from a multiple compartment bin unit, comprising:

an elongated frame having fixed position platforms at regularly spaced intervals, each serving as a gripper arm;

a plurality of movable gripper arms, one for each platform, each said platform and movable arm constituting a pair of gripper arms;

each gripper arm carried by means on said frame for shiftability of the arm between an open position spaced from its cooperating platform arm, and a position closer to the platform arm;

a ratchet drive means with a pistol grip handle and finger operated lever for manual operation;

a gang interconnecting means for driving said movable arms in unison; and means for transfer of drive from said ratchet drive means to said gang interconnecting means.

3. An unloader as defined in claim 2 wherein said gang interconnecting means is a rod and yieldable interconnecting means from the rod to the individual movable gripper arms, whereby compensating yieldability is provided to the individual pair of gripper arms for variations in paper stack height.

4. An unloader as defined in claim 2 wherein said gang interconnecting means is a rod and yieldable interconnecting means from the rod to the individual movable gripper arms, and said ratchet drive means is in drive relationship to one only of said movable gripper arms, whereby that arm through its yieldable interconnection drives the gang interconnecting means.

* * * * *